United States Patent [19]

Dove

[11] 4,422,575

[45] Dec. 27, 1983

[54] STEAM DISTRIBUTOR WITH PLUG VALVE

[76] Inventor: Norman F. Dove, 1493 Crown St., North Vancouver, British Columbia, Canada, V7J 1G4

[21] Appl. No.: 293,113

[22] Filed: Aug. 17, 1981

[51] Int. Cl.[3] ..... A62C 37/20

[52] U.S. Cl. ..... 239/562; 34/155

[58] Field of Search ..... 239/562, 553, 553.3, 239/583; 34/155, 160; 162/290, 359, 207

[56] References Cited

U.S. PATENT DOCUMENTS 4,268,976 5/1981 Dove ..... 239/553.3 X 4,294,406 10/1981 Pernick ..... 239/562 X

*Primary Examiner*—John J. Love

*Assistant Examiner*—Gene A. Church

*Attorney, Agent, or Firm*—Spensley, Horn, Jubas & Lubitz

[57] ABSTRACT

A steam distributor to apply steam to a paper sheet moving beneath it. The distributor has a steam supply header. A chamber receives steam from the header. There are outlets in the chamber whereby steam is passed to the paper sheet. Pipes communicate the header with the chamber and there is an outlet for each pipe in the chamber and an inlet for each pipe to allow steam into the paper from the header. A valve member extends to an open end of the pipe and co-operates with the open end to control the flow of steam through the open end. The valve member can be moved towards and away from the open end of the pipe.

10 Claims, 5 Drawing Figures

STEAM DISTRIBUTOR WITH PLUG VALVE

FIELD OF THE INVENTION

This invention relates to a steam distributor to apply steam to a paper sheet moving beneath it.

DESCRIPTION OF THE PRIOR ART

The steam heating of a paper sheet is widely practised in paper making. The increase in sheet temperature that results provides increased drainage rates for the water thus reducing the amount of water to be evaporated in the drier section. Water drainage is improved by the application of steam principally because the heating of the sheet reduces the viscosity of the water, thus increasing the ability of the water to flow. Most of the heat transfer takes place when the steam condenses in the sheet. The condensation of the steam transforms the latent heat of the steam to sensible heat in the water contained by the sheet.

A particular advantage of the steam heating of the paper sheet is that the amount of steam applied may be varied across the width of the sheet, in the cross machine direction, so that the cross machine moisture profile of the sheet may be modified. This is usually carried out to ensure that the moisture profile at the reel is uniform. Apparatus are well known in the paper making art that can sense the moisture profile of a sheet of paper. If such an apparatus is positioned over the paper sheet, downstream of a steam distributor able to control the moisture profile, then after measuring the water profile in the sheet, steam can be applied in varying amounts on a selective basis across the sheet, thus achieving the required uniform moisture profile at the reel.

It is known to divide a steam distributor into compartments and to control the supply of steam to each compartment, thus controlling the moisture profile of the sheet.

In relatively recent developments the control of the flow of the steam is by a piston acting as a valve in a pipe. Steam may be passed from a header arranged within a chamber or adjacent the chamber. There is an opening in either the header or the chamber and another opening in the pipe in the header or the chamber. One of the openings is in the wall of the pipe and this opening is controlled by a piston extending on a rod into the pipe to close or open the opening in the wall of the pipe. A regulator, typically controlled by compressed air, extends above the apparatus. Upon the receipt of a signal the air supply to the regulator may be increased or decreased to move the piston within the pipe and thus open or close, partially or completely, the opening in the pipe.

The prior art is, for example, illustrated in my U.S. patent application Ser. No. 190,472 filed Sept. 24th, 1980; my U.S. patent application Ser. No. 162,270 filed June 23rd, 1980 and my U.S. application Ser. No. 238,249 filed Feb. 25th, 1981 as a continuation-in-part of application Ser. No. 171,482 which has a continuation-in-part of my application Ser. No. 924,639.

SUMMARY OF THE INVENTION

The present invention may use a regulator similar to the arrangement described in my above United States patent applications but discloses a means of regulating the flow within the pipe that is preferred to the use of a piston.

Accordingly, the present invention provides a steam distributor to apply steam to a paper sheet moving beneath it, the distributor comprising: a steam supply header; a chamber to receive steam from the header; outlets in the chamber whereby steam is passed to the paper sheet; partitions dividing the chamber into a plurality of compartments: pipes communicating the header with the chamber; an outlet for each pipe in the chamber; an inlet for each pipe in the header; a valve member extending to an open end of the pipe and cooperating with the open end to control the flow of steam through the open end; and means to reciprocate the valve member towards and away from the open end of the pipe.

The valve member may be a piston movable to abut an open end of the pipe to close that pipe and thus prevent steam flow in the pipe. The valve member may be a plug fitting just within the end of the pipe. Idents are preferably cut into the plug member and this permits a gradual opening of the pipe as the plug is withdrawn from the pipe. This also provides good control of the amount of flow in the pipe. The plug may be a hollow tube.

The regulator, as in the prior art listed above, is typically a regulator controlled by an air supply. There is a rod extending from the regulator to the valve member. The valve member is thus moved by the application of compressed air to close it. Typically resilient means such as a spring act to open the valve when the pressure of air is reduced below a predetermined value. This may be reversed, that is air may be used to open the valve and a spring to close it.

BRIEF DESCRIPTION OF THE DRAWINGS

Aspects of the invention are illustrated, merely by way of example, in the drawings in which.

DESCRIPTION OF THE PREFERRED EMBODIMENTS

Figure 1:
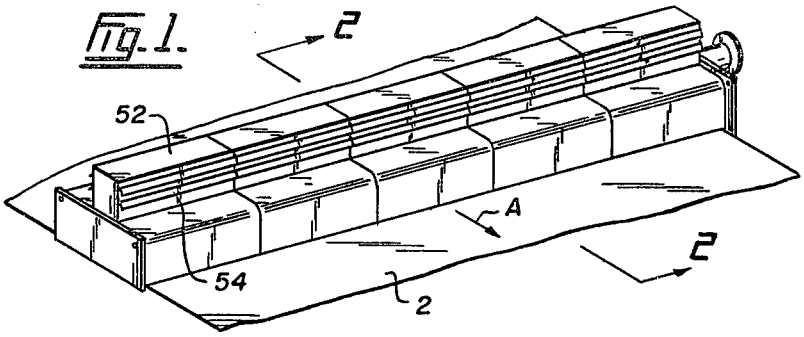
FIG. 1 is a general view of a steam distributor according to the present invention.

FIG. 1 illustrates a steam distributor positioned above a paper sheet 2 moving beneath the distributor in the direction of arrow A. As illustrated more particularly in FIG. 2 there is a steam supply header 4 and a chamber 6 receives steam from the header 4. There are outlets 8 in the chamber 6 whereby steam is passed to the paper sheet 2. In the illustrated embodiment of FIG. 2 there is a second header 10 which receives steam from the first header in order that a steam curtain may be formed through openings 12 in a subchamber 14 formed adjacent the second header 10. However, this feature does not form a part of the present invention and will not be described further. The apparatus is illustrated to show the application of the invention to a modern steam distributor.

Figure 2:
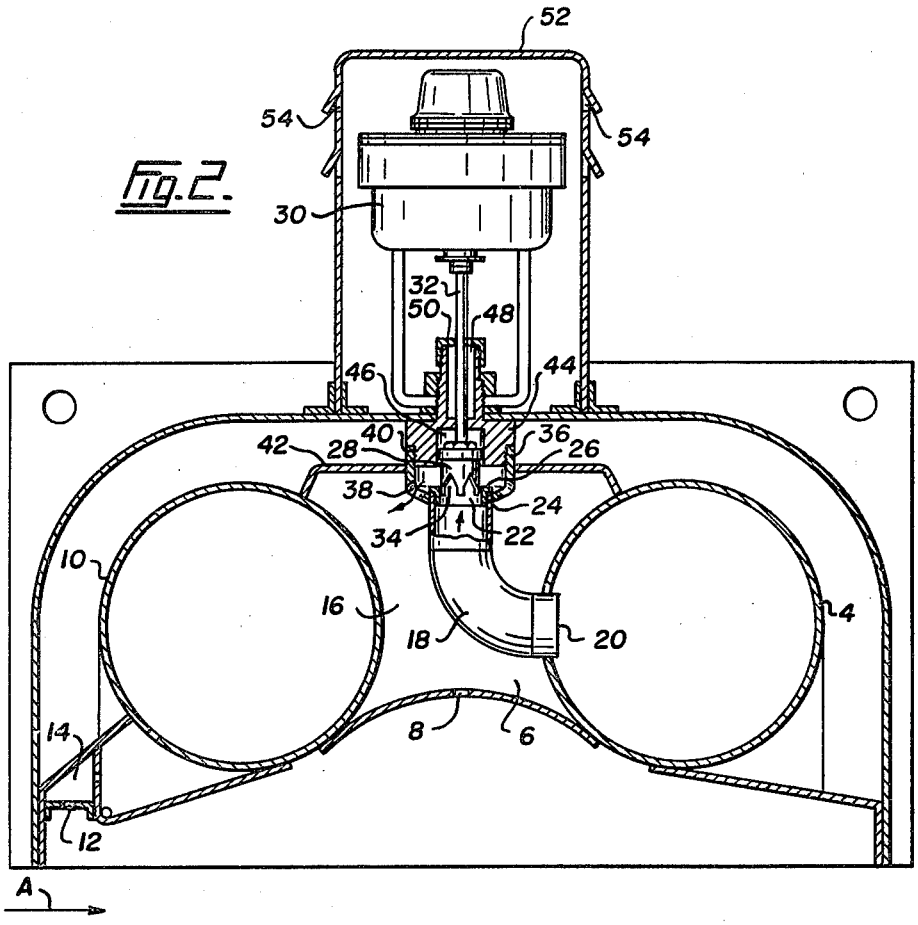
FIG. 2 is a section on the line 2—2 of FIG. 1.

Partitions 16 divide the chamber 6 into a plurality of compartments and there are pipes 18 communicating the header 4 with the chamber 6. There is an inlet 20 for each pipe 18 in header 4 and an outlet 22 for each pipe in the chamber 6. In the embodiment of FIG. 2 the pipe has an internal thread at 24 to receive a threaded insert 26. A valve member 28 extends to end 22 of the pipe 18, to contact the insert 26, and co-operates with the insert 26 to control the flow of steam through the pipe 18. There are means to reciprocate the valve member 28. In the embodiment of FIG. 2 that means comprises an air actuator 30. The application of compressed air acts on a diaphragm (not shown) within the actuator 30. A connecting rod 32 is attached to the diaphragm and to valve member 28. The valve member in the illustrated embodiment of FIG. 2 comprises a tubular plug member fitting within the end of the pipe 18. There are indents 34 cut into the tubular plug member and these indents 34 permit a gradual opening of the pipe 18 as the plug is withdrawn from the pipe 18 and a gradual closing of the pipe 18 as the plug is moved into the pipe 18.

The connecting rod 32 passes through a sealing arrangement comprising a widened tubular portion 36 attached to the exterior of the upper end of the pipe 18 and having openings 38 formed in it. This widened portion 36 has an internal thread 40 formed adjacent upper wall 42 of the chamber 6. A sealing member 44 with an external thread is engaged in the internal thread 40 of the widened portion 36. There is a recess 46 to accommodate the withdrawn plug member. A sealing member 48, for example containing packing rings, surrounds the connecting rod 32. The chamber 48 is closed by a cap 50 threadedly engaged on the exterior. The actuator 30 in the illustrated embodiment is enclosed in a casing 52 provided with ventilation openings 54.

The embodiment of FIG. 2 functions in the following manner:

The moisture profile of the sheet 2 is sensed downstream of the illustrated steam distributor. If the profile is non-uniform then the sensor sends a signal to a process controlling computer occasionally but more usually the signal is read by an operator in a control room. The computer or operator sends a signal arranging that additional steam be provided upstream of the sensor, by the steam distributor, at those parts of the sheet where the moisture content is high. This ensures additional heating and thus additional water removal at the parts of the sheet with a high water content at the sensor. The signal operates to increase or decrease the supply of air to the actuator 30 to open or close the pipe 16 by moving the valve member 28 upwardly or downwardly.

Figure 3:
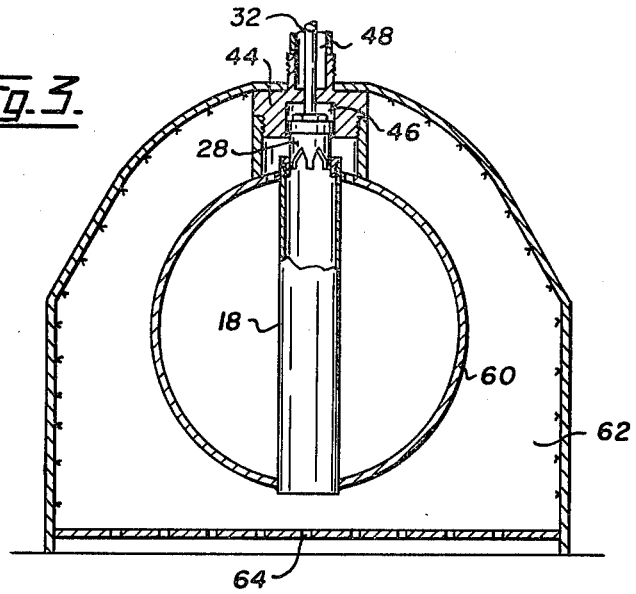
FIG. 3 illustrates a further aspect of the present invention.

FIG. 3 illustrates an embodiment of the invention that is simply steam distributor for controlling the profile but, in its control of steam supply, it may be precisely the same as in FIG. 2. That is the tubular plug member that makes up valve member 28 is precisely the same. It comprises a header 60 within a chamber 62. Pipe 18 passes through the header 60 and steam is passed out of the chamber 62 through outlets 64. Control and operation of the embodiment of FIG. 3 is precisely the same as illustrated in FIG. 2.

Figure 4:
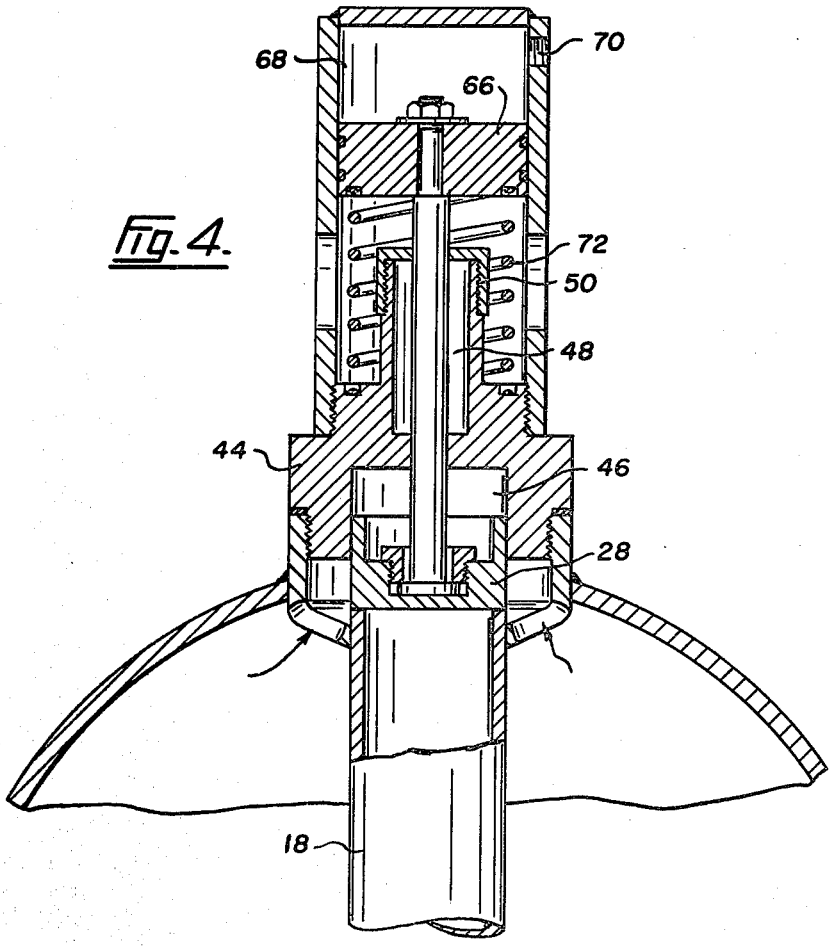
FIG. 4 illustrates yet a further aspect.

The embodiment of FIG. 4 is also similar to the embodiment of FIG. 2 but the actuator is of a different configuration and the valve member is flat based and abuts the top of pipe 18. The structural details of the piston and connecting rod are as for the embodiment of FIG. 2. However, the movement of the valve member 28 upwardly or downwardly is by a piston 66 acting within cylinder 68. There is a supply of air to the cylinder through port 70. Air is used to move the piston 66 downwardly to close the valve member 28 by making it abut the top of pipe 18. Spring 72 applies an upwards force to move the piston 66 upwardly to open the pipe 18 by moving the valve member 28 away from it. Thus, control of the profiling is again by air supply. If the air pressure is increased the valve member 28 closes off the pipe 18 if the air pressure is decreased the spring 72 moves the piston 66 upwardly in the cylinder thus opening the pipe 18.

Figure 5:
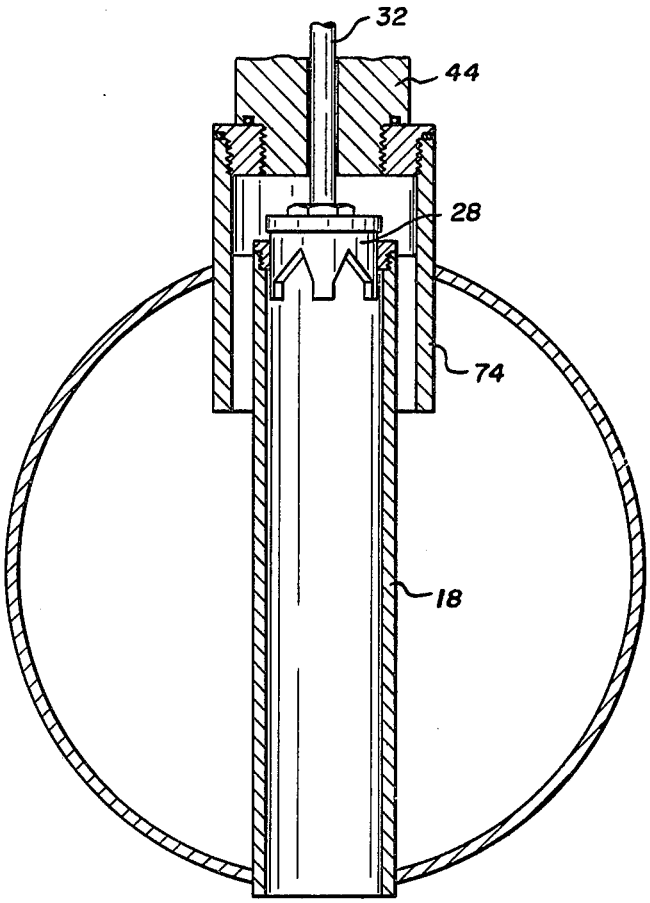
FIG. 5 illustrates a section through a yet further embodiment of the invention.

The embodiment of FIG. 5 is a preferred embodiment in that it also provides an extremely effective steam trap. A second pipe 74 is arranged substantially concentrically around the pipe 18. Steam must pass upwardly between the two pipes 74 and 18 and the upward movement ensures that condensate will not enter pipe 18. Otherwise the operation of the member illustrated in FIG. 5 is precisely as described for the embodiment of FIG. 2. It should, of course be emphasized that in both the embodiments of FIGS. 4 and 5 there will be a steam chamber surrounding the illustrated headers. The Figure embodiment provides an excellent steam trap benefit, especially when used upside down from the position shown in FIG. 5.

I claim:

1. A steam distributor to apply steam to a paper sheet moving beneath it, the distributor comprising:

a steam supply header;

a chamber to receive steam from the header;

outlets in the chamber whereby steam is passed to the paper sheet;

first pipes communicating the header with the chamber;

an outlet for each first pipe in the chamber;

an inlet for each first pipe to allow steam into the pipe from the header;

a valve member extending to an open end of each first pipe and co-operating with the open end to control the flow of steam through the open end;

means to reciprocate the valve member towards and away from the open end of the pipe;

first locating means locating the valve member in the distributor; and second locating means locating each first pipe relative to the first locating means to maintain the pipe in constant alignment with the valve member.

2. A distributor as claimed in claim 1 including partitions dividing the chamber into a plurality of compartments.

3. A distributor as claimed in claim 1 in which the valve member is a piston moved to abut an open end of the pipe.

4. A distributor as claimed in claim 1 in which the valve member is a plug member to fit within an end of the first pipe;

indents cut into the plug member to permit a gradual opening of the pipe as the plug is withdrawn from the pipe.

5. A distributor as claimed in claim 1 in which: the means to reciprocate the valve member is a regulator controlled by air supply; and a rod extending from the regulator to the valve member.

6. A distributor as claimed in claim 5 in which the regulator has a diaphragm, air pressure on the diaphragm acting to move the diaphragm and thus the connecting rod and the valve member towards the open end of the pipe;

spring means urging the valve member away from the open end of the pipe;

7. A distributor as claimed in claim 5 in which the regulator has a piston movable within a cylinder with an air supply to the cylinder to act on the piston;

spring means tending to move the piston against the air pressure in the cylinder.

8. A distributor as claimed in claim 1 having a second pipe surrounding each first pipe adjacent the inlet for each first pipe whereby steam must pass between the first and second pipes to reach the first pipe inlet.

9. Apparatus to control gas flow and comprising:

a header;

an inner pipe located within the header and having an inlet and an outlet;

a valve member extending to an open end of the inner pipe and co-operating with the open end;

an outer pipe arranged around the inner pipe adjacent the valve member whereby gas must pass between the inner and outer pipes to pass through said open end of the inner pipe;

first locating means locating the valve member and the outer pipe relative to the header; and second locating means locating the inner pipe relative to the first locating means to maintain the inner pipe in constant alignment with the valve member.

10. Apparatus as claimed in claim 9 in which the valve member is a plug member to fit within an open end of the inner pipe;

indents cut into the plug member to permit a gradual opening of the inner pipe as the plug is withdrawn from the inner pipe.

* * * * *